United States Patent [19]

Ussat et al.

[11] Patent Number: 5,076,955

[45] Date of Patent: Dec. 31, 1991

[54] ACIDIC CLEANING AGENT WITH A SCOURING ACTION

[75] Inventors: Wolfgang Ussat, Limburger; Bernhard Waessa, Otterstadt, both of Fed. Rep. of Germany

[73] Assignee: Joh. A. Benckiser GmbH, Ludwigshafen, Fed. Rep. of Germany

[21] Appl. No.: 493,816

[22] Filed: Mar. 15, 1990

[30] Foreign Application Priority Data

Mar. 18, 1989 [DE] Fed. Rep. of Germany ..... 3908971

[51] Int. Cl.[5] ..... C11D 3/33; C11D 3/43

[52] U.S. Cl. ..... 252/142; 252/145; 252/173; 252/174.21; 252/134; 252/133; 252/146; 252/148; 252/174.15; 252/559; 252/554; 252/174.25

[58] Field of Search ..... 252/142, 145, 173, 174.21, 252/134, 133, 146, 148, 174.15, 559, 554, 174.25

[56] References Cited

U.S. PATENT DOCUMENTS 4,101,437 7/1978 Rones ..... 252/146

4,124,525 11/1978 Johnson ..... 252/145

*Primary Examiner*—Paul Lieberman

*Assistant Examiner*—Kevin D. McCarthy

*Attorney, Agent, or Firm*—Foley & Lardner

[57] ABSTRACT

The present invention provides a composition and a method for producing a composition that is an acidic, viscous, stable cleaning agent with a scouring action. The cleaning agent comprises an anionic surfactant comprised of a linear alkylbenzenesulphonate or alkane sulphonate in an amount of 1 to 10% by weight; a non-ionic surfactant comprising a fatty alcohol oxyethylate in an amount of about 0.5 to 2% by weight; fatty acids with a carbon chain length of $C_{12}$-$C_{18}$ in an amount of about 0.1 to 0.5% by weight; mono- or sesquiterpenes or mixtures thereof in an amount of 0-2% by weight; a silicone in an amount of about 0.5 to 2% by weight; scouring agents in the form of alumina mixtures of various particle sizes in an amount of about 20 to 60% by weight; acids for the adjustment of a pH value of 2.5 to 4 in the form of a mixture of citric acid and amidosulphonic acid; and water, perfume oil, coloring materials added to provide a total of 100% by weight.

25 Claims, No Drawings

ACIDIC CLEANING AGENT WITH A SCOURING ACTION

BACKGROUND OF THE INVENTION

The present invention relates to a viscous, liquid cleaning agent with a scouring action for cleaning acid-resistant, hard surfaces in the household and especially for cleaning glass ceramics.

Cleaners for hard surfaces in the household are necessary, for example, for metals, glass, ceramics, synthetic materials, glass ceramics and the like. Such cleaners can be powdery, pasty or liquid. The liquid products have the advantage that, immediately after application to the surface to be cleaned, they manifest a cleaning ability, insofar as they are intended, for the removal of fat-containing and lime-containing dirt.

A number of liquid products have the deficiency that they are not acid adjusted. Stubborn contaminations, e.g., aged, lime-containing contaminations, especially on glass ceramic cooking plates, can be removed from such products only very unsatisfactorily.

Another disadvantage of liquid cleaners is the absence of abrasively-acting scouring agents which render ineffective the removal of aged lime-containing contaminations which are firmly adhered to surfaces due to the action of temperature.

For better dissolving of fat-containing dirt or for sufficient stability, liquid cleaners can contain more or less large amounts of organic solvents. However, these solvents represent an additional burden on the ecosystem and therefore reduce the suitability of such cleaners.

Liquid cleaners which contain abrasives can also display deficiencies with regard to their storage stability. Various thickening agents, for example polyacrylates, have been suggested for overcoming this deficiency.

More particularly, German Patent No. 28 43 160 describes products which have been rendered acidic with amidosulphonic acid but which cause negative effects on the air in a room and which are also inflammable due to their containing isopropyl alcohol and other organic solvents.

German Patent No. 33 27 926 refers to the use of acids, for example citric acid, amidosulphonic acid and the like or mixtures thereof, in order to adjust the pH to the range of 3 to 3.5. Here, too, organic solvents, such as hydrocarbons, must be employed that have the disadvantages of contaminating the air in the room and inflammability.

European Patent Specification No. 0,216,416, describes a system which utilizes natural minerals, benzyl alcohol and polymeric thickeners. Natural minerals have proved to have a negative effect since they can contain scouring agent components with a high degree of hardness which bring about considerable wear. Amounts of benzyl alcohol are also necessary as a polar solvent.

In all, known cleaning agents have the disadvantage that they do not satisfactorily clean or they damage the surfaces of, for example, glass ceramic cooking plates or, in the case of application to hot cooking plates, attack these chemically.

SUMMARY OF THE INVENTION

Accordingly, it is an object of the present invention to provide a viscous, liquid cleaning agent with a scouring action for cleaning acidresistant, hard surfaces in the household and especially for cleaning glass ceramics.

Another object of the present invention to provide a cleaning agent which, inter alia, can clean even hot cooking plates especially well without attacking the surfaces thereof.

A further object of the present invention is to provide an acidic cleaning agent of higher stability against demixing in which the viscosity necessary for the achievement of stability is, according to the present invention, achieved without the use of thickening agents.

Another object of the present invention is to provide a method for producing a viscous, liquid cleaning agent with a scouring action for cleaning acid-resistant, hard surfaces in the household and especially for cleaning glass ceramics.

In accomplishing the foregoing objects, there has been provided, in accordance with one aspect of the present invention, a cleaning agent in the form of a paste which has a viscosity at 20° C. of from about 7000 to 9000 mPas and especially from about 7500 to 8500 mPas. In accordance with another aspect of the present invention there is provided an agent comprising, as an anionic surfactant from about 1 to 10% by weight of a linear alkylbenzenesulphonate or alkane sulphonate; as a nonionic surfactant from about 0.5 to 2% by weight of a fatty alcohol oxyethylate; from about 0.1 to 0.5% by weight of at least one one fatty acids with a carbon chain length of $C_{12}$–$C_{18}$; from about 0 to 2% by weight of a monoterpene or sesquiterpene or a mixture thereof; from about 0.5 to 2% by weight of a silicone; from about 20 to 60% by weight of a scouring agent in the form of alumina mixtures of various particle sizes; at least one acid for the adjustment of a pH value of from 2.5 to 4 in the form of a mixture of citric acid and amidosulphonic acid; and water, perfume oil, and coloring material added to provide a total of 100% by weight.

According to still another aspect of the present invention, the use of a cleaning agent is provided for cleaning hard surfaces. In a preferred embodiment, the hard surface is selected from the group consisting of a metal, glass, a synthetic material and a ceramic, especially a glass ceramic.

According to another aspect of the present invention, there is provided a method for the production of an acidic, viscous, stable cleaning agent with a scouring action. Such a process comprises the steps of (A) producing a pre-mixture by successive introduction into water of aqueous sodium hydroxide solution, sodium carbonate, a fatty acid mixture, a coloring material, alkylbenzenesulphonic acid or sodium alkanesulphonate, ionic surfactant and a perfume; (B) adjusting a pH of the premixture to a value of about 10.3; (C) adding sequentially to the premixture polishing alumina and silicone oil by vigorous stirring to from a mixture; and (D) adding citric acid and amidosulphonic acid to the mixture until a pH value of 2.5 to 4 is achieved. Preferably, the citric acid and amidosulphonic acid are introduced until a pH value of 3 to 3.5 is achieved. Alternatively, it is preferable that the citric acid and the alkylbenzenesulphonic acid are added into the premixture.

Thus, the present invention provides an acidic, viscous cleaning agent with a scouring action which is free from solvents which would bring about an unnecessary burdening of the air of the room and give rise to a danger of ignition.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DETAILED DESCRIPTION OF THE PREFERRED EMBODIMENTS

The present invention provides an acidic cleaning agent of higher stability against demixing in which the viscosity necessary for the achievement of stability is, according to the present invention, achieved without the use of thickening agents.

In particular, the present invention provides an agent which is especially suitable for cleaning glass ceramic surfaces and is effective without chemically or mechanically attacking the surfaces.

A description of components of a cleaning agent according to the present invention is, e.g., as follows. The agent can preferably contain anionic surfactants, e.g., such as linear alkylbenzenesulphonate wherein the alkyl chain contains 10 to 13 carbon atoms or secondary alkanesulphonate with a $C_{13}$–$C_{18}$ alkyl chain, for example in each case in the form of sodium salts. As nonionic surfactants there can be used condensates of fatty alcohols with a chain length of $C_{10}$ with 7 or 11 moles of ethylene oxide or with a chain length of $C_{11}$14 $C_{13}$ with 7 or 11 moles of ethylene oxide. A mixture of fatty acids can also be used according to the present invention and is obtainable by the decomposition of coconut fat, e.g., $C_{10}$ 2%, $C_{12}$ 52%, $C_{14}$ 22%, $C_{16}$ 12%, $C_{18}$ 2%, $C_{18}$ a unsaturated once 9%; $C_{18}$ unsaturated twice 1%.

As mono- or sesquiterpenes according to the present invention terpineols can be used, e.g., as a mixture of $\alpha$-, $\beta$- and $\gamma$-isomers of p-menthenols.

Silicones that can be used according to the present invention are preferably, e.g, as polymethylsiloxanes with a viscosity of 50 to 150 mPas. Preferably dimethylsiloxane can be used as 1% by weight.

Polishing aluminas used according to the present invention as components of the cleaning agent are preferably mixtures with characteristics such as

- polishing alumina P2>63 μm-maximum 5%, bulk density of 800 to 950 g/liter
- polishing alumina P10>63 μm-30 to 50%; bulk density 850 to 950 g/liter
- polishing alumina P6>63 μm-15 to 25%; bulk density 850 to 950 g/liter
- polishing alumina P10 finest <20 μm minimum 95%; bulk density 550 to 650 g/liter.

Preferably an acid mixture of citric acid and amidosulphonic acid is used according to the present invention for the adjustment of a pH value in the range of from 2.5 to 4, and more preferably from 3.0 to 3.5. In contradistinction to acids such as alkylbenzenesulphonic acid or phosphoric acid, the use of such an acid mixture, according to one aspect of the present invention, surprisingly provides the advantage that the use of an acid cleaning agent of the present invention does not attack or damage glass ceramic surfaces at elevated temperatures. However, the use of amidosulphonic acid alone for the acid adjustment of the formulation or cleaning agent gives a product with insufficient lime removal.

For an example of one method of producing a cleaning agent according to the present invention, a premixture is prepared wherein aqueous sodium hydroxide solution, sodium carbonate, fatty acid, coloring material, alkylbenzenesulphonic acid, non-ionic tenside and perfume are successively introduced into water. The pH value of a pre-mixture is preferably basic, more preferably about 10.3. Into the pre-mixture are introduced, with vigorous stirring, polishing aluminas, subsequently added are silicone oil and thereafter acids, the introduction of the acids being continued until a pH value of 3 to 3.5 has been reached. Citric acid can also, in part, be introduced into the premixture together with the alkylbenzenesulphonic acid.

According to the present invention, an alternative method of preparing a cleaning agent by the use of alkanesulphonate takes place in such a manner that a pre-mixture is produced by successively introducing aqueous sodium hydroxide solution, sodium carbonate, fatty acid, coloring material, sodium alkanesulphonate and non-ionic surfactant into water. The pH value of the premixture should be 10.3. Into the pre-mixture are introduced, with vigorous stirring, the polishing alumina, the silicone oil and thereafter the acids, with the introduction of the acids being continued until a pH value of 3 to 3.5 has been reached.

Examples of a cleaning agent according to the present invention were tested with regard to stability over a period of time of 2 months. Testing of a cleaning agent of the present invention for scratching showed no negative effects. The cleaning ability of a cleaning agent according to the present invention with regard to dried up milk and dried up foodstuffs of the formulations described in the following examples was comparably good.

In the following table, the examples provided in columns 1 to 3 are cleaning agents according to the present invention, while the other columns show examples for the purpose of comparison. The Table also gives the results obtained in the testing of the various cleaning agents. These tests indicates with a value of 0 that the present invention provides no scratching to be ascertainable after use; no chemical attack occurs at a temperature of 600° C.; when used for cleaning off of foodstuffs or milk, the foodstuff contaminations are completely removed, as well as the lime.

A value of 2 in the comparison examples shows insufficient removal or considerable chemical attack or scratching.

TABLE

| | 1 | 2 | 3 | 4 | 5 | 6 | 7 |
|---|---|---|---|---|---|---|---|
| water, completely desalinated | 40.2 | 39.7 | 40.2 | 44.0 | 40.7 | 39.7 | 35.3 |
| aqueous sodium hydroxide solution, 50% | 1.6 | 1.6 | 1.6 | 0.9 | 1.6 | 1.6 | 1.6 |
| sodium carbonate | 1.0 | 1.0 | 1.0 | 1.0 | 1.0 | 1.0 | 1.0 |
| coconut fatty acid Edenor K1218 | 0.2 | 0.2 | 0.2 | 0.2 | 0.2 | 0.2 | 0.2 |
| colouring material solution | + | + | + | + | + | + | + |
| alkylbenzenesulphonic acid | 4.0 | 4.0 | 4.0 | 4.0 | 4.0 | 4.0 | 4.0 |
| Lutensol ON 110 | 1.0 | 1.0 | – | 1.0 | 1.0 | 1.0 | 1.0 |

TABLE-continued

| | 1 | 2 | 3 | 4 | 5 | 6 | 7 |
|---|---|---|---|---|---|---|---|
| Lutensol ON 70 } fatty alcohol oxyethylate | – | – | 1.0 | – | – | – | – |
| terpeneol | – | 0.5 | – | 0.5 | 0.5 | 0.5 | 0.5 |
| perfume | 0.4 | 0.4 | 0.4 | 0.4 | 0.4 | 0.4 | 0.4 |
| polishing alumina P2 | 27.0 | 27.0 | 27.0 | 27.0 | 27.0 | – | 27.0 |
| polishing alumina P6 | – | – | – | – | – | 45.0 | – |
| polishing alumina P10 | 18.0 | 18.0 | 18.0 | 18.0 | 18.0 | – | 18.0 |
| dimethylsiloxane AK 100 | 1.0 | 1.0 | 1.0 | 1.0 | 1.0 | 1.0 | 1.0 |
| citric acid solution, 50% | 3.6 | 3.6 | 3.6 | – | 11.0 | 3.6 | – |
| amidosulphonic acid | 2.0 | 2.0 | 2.0 | 2.0 | – | 2.0 | – |
| lactic acid | – | – | – | – | – | – | 10.0 |
| tendency to precipitate | very slight | very slight | very slight | very slight | very slight | strong | strong |
| scratching | 0 | 0 | 0 | 0 | 0 | | |
| chemical attack at 600° C. | 0 | 0 | 0 | 0 | 2 | | |
| cleaning off foodstuffs, milk | 0 | 0 | 0 | 0 | 0 | | |
| removal of lime | 0 | 0 | 0 | 2 | 0 | | |

What is claimed is:

1. An acidic cleaning agent comprising:

(a) from about 1 to 10% by weight of a linear alkylbenzenesulphonate or alkane sulphonate;

(b) from about 0.5 to 2% by weight of a fatty alcohol oxyethylate;

(c) from about 0.1 to 0.5% by weight of at least one fatty acids with a carbon chain length of $C_{12}$–$C_{18}$;

(d) from about 0 to 2% by weight of a monoterpene or sesquiterpene or a mixture thereof;

(e) from about 0.5 to 2% by weight of a silicone;

(f) from about 20 to 60% by weight of a scouring agent in the form of alumina mixtures of various particle sizes;

(g) acid for the adjustment of a pH value of from 2.5 to 4 in the form of a mixture of citric acid and amidosulphonic acid;

and water, perfume oil, and coloring material added to provide a total of 100% by weight.

2. A cleaning agent according to claim 1, comprising about 4% by weight of said linear alkylbenzenesulphonate or alkane suphonate.

3. A cleaning agent according to claim 1, comprising about 1% by weight of said fatty alcohol oxyethylate.

4. A cleaning agent according to claim 1, comprising about 0.2% by weight of said at least one fatty acid.

5. A cleaning agent according to claim 1, wherein component (d) is a terpene mixture comprising terpineol and in an amount of about 1.0% by weight.

6. A cleaning agent according to claim 1, wherein said silicone comprises a polymethylsiloxane.

7. A cleaning agent according to claim 6, wherein said polymethylsiloxane comprises dimethyl siloxane and is present in an amount of about 1% by weight.

8. A cleaning agent according to claim 1, wherein said alumina mixture comprises polishing alumina having a particle diameter of at least 63 μm-a maximum of 5%, and a bulk density of 800 to 950 g/liter and is present in an amount of about 27% by weight.

9. A cleaning agent according to claim 1, wherein said alumina mixture comprises polishing alumina having a particle diameter of less than 20 μm-a minimum of 95%, and a bulk density of 550 to 650 g/liter and is present in an amount of about 18% by weight.

10. A cleaning agent according to claim 1, wherein said citric acid is provided in an amount of about 2% by weight and said amidosulphonic acid is present in an amount of about 2% by weight.

11. A cleaning agent according to claim 1, having a viscosity in the range of from about 7000 to 9000 mPas.

12. A cleaning agent according to claim 1, having a viscosity in the range of from about 7500 to 8500 mPas.

13. A cleaning agent according to claim 1, having a pH value of from about 3 to 3.5.

14. A method of cleaning a hard surface, comprising the step of applying an aqueous mixture containing a cleaning agent as defined by claim 1.

15. A method according to claim 14, wherein said hard surface is selected from the group consisting of a metal, glass, a synthetic material and a ceramic.

16. A method according to claim 15, wherein said ceramic is a glass ceramic.

17. A process for the production of an acidic, viscous, stable cleaning agent with a scouring action, comprising the steps of (A) producing a pre-mixture by successive introduction into water of aqueous sodium hydroxide solution, sodium carbonate, from about 0.1 to 0.5% by weight of one or more fatty acids with a carbon chain length of $C_{12}$–$C_{18}$, a coloring material, from about 1 to 10% by weight of a linear alkylbenzenesulphonate or alkane sulphonate, from about 0.5 to 2% by weight of a fatty alcohol oxyethylate, from about 0 to 2% by weight of a monoterpene or sesquiterpene or a mixture thereof, and a perfume oil, (B) adjusting a pH of said premixture to a value of about 10.3;

(C) adding sequentially to said premixture from about 20 to 60% by weight of a scouring agent in the form of alumina mixtures of various particle sizes and from about 0.5 to 2% by weight of a silicone by vigorous stirring to form a mixture; and (D) adding citric acid and amidosulphonic acid to said mixture in an amount sufficient to produce a pH value of 2.5 to 4.

18. A process according to claim 17, wherein the citric acid and amidosulphonic acid are introduced until a pH value of 3 to 3.5 is achieved.

19. A process according to claim 18, wherein said citric acid and said alkylbenzenesulphonic acid are added into said pre-mixture.

20. A cleaning agent according to claim 1, wherein said amidosulphonic acid and said citric acid are each present in substantial amounts.

21. A cleaning agent according to claim 20, wherein said amidosulphonic acid and said citric acid are each present in substantially equal amounts.

22. A cleaning agent according to claim 1, wherein said citric acid is present in an amount such that said agent displays enhanced lime removal.

23. A process according to claim 17, wherein in step (D) said amidosulphonic acid and said citric acid are added in substantial amounts.

24. A process according to claim 23, wherein in step (D) said amidosulphonic acid and said citric acid are added in substantially equal amounts.

25. A process according to claim 17, wherein in step (D) said citric acid is added in an amount such that said agent displays enhanced lime removal.

* * * * *